US008596201B2

(12) United States Patent
Kral

(10) Patent No.: US 8,596,201 B2
(45) Date of Patent: Dec. 3, 2013

(54) ENGINE WARMING SYSTEM FOR A MULTI-ENGINE MACHINE

(75) Inventor: John F. Kral, Plainfield, IL (US)

(73) Assignee: Progress Rail Services Corp, Albertville, AL (US)

( * ) Notice: Subject to any disclaimer, the term of this patent is extended or adjusted under 35 U.S.C. 154(b) by 167 days.

(21) Appl. No.: 13/326,855

(22) Filed: Dec. 15, 2011

(65) Prior Publication Data

US 2013/0152819 A1 Jun. 20, 2013

(51) Int. Cl.
*B61C 5/00* (2006.01)

(52) U.S. Cl.
USPC ..... 105/62.2; 105/62.1; 123/142.5 R

(58) Field of Classification Search
USPC ..... 105/26.05, 35, 49, 50, 61, 62.1, 62.2, 105/36, 37, 64.1; 123/142.5 R
See application file for complete search history.

(56) References Cited

U.S. PATENT DOCUMENTS

| | | | | |
|---|---|---|---|---|
| 1,803,876 | A * | 5/1931 | Sperry | 290/3 |
| 2,663,803 | A * | 12/1953 | Warrick et al. | 290/4 C |
| 3,209,704 | A * | 10/1965 | Gratzmuller | 105/35 |
| 3,244,115 | A * | 4/1966 | Romaus | 105/62.2 |
| 4,424,775 | A * | 1/1984 | Mayfield et al. | 123/142.5 R |
| 4,749,469 | A * | 6/1988 | Beerbaum | 208/72 |
| 4,944,343 | A * | 7/1990 | Muller | 165/47 |
| 5,411,005 | A * | 5/1995 | Bohl et al. | 123/557 |
| 5,566,745 | A * | 10/1996 | Hill et al. | 165/299 |
| 5,669,311 | A * | 9/1997 | Hill et al. | 105/62.2 |
| 6,636,798 | B2 * | 10/2003 | Biess et al. | 701/112 |
| 7,431,005 | B2 * | 10/2008 | Hawkins et al. | 123/179.4 |
| 7,518,254 | B2 * | 4/2009 | Donnelly et al. | 290/40 C |
| 7,963,271 | B2 * | 6/2011 | Samanta et al. | 123/557 |
| 8,171,860 | B1 * | 5/2012 | Miller et al. | 105/49 |
| 8,381,658 | B1 * | 2/2013 | Miller et al. | 105/50 |
| 2006/0042583 | A1 * | 3/2006 | Bourgault et al. | 123/142.5 R |
| 2008/0092859 | A1 * | 4/2008 | Little, III | 123/557 |
| 2010/0071639 | A1 * | 3/2010 | Wegner et al. | 123/41.08 |
| 2010/0089342 | A1 * | 4/2010 | Wegner et al. | 123/41.08 |
| 2010/0170414 | A1 * | 7/2010 | Hardin et al. | 105/35 |
| 2012/0118248 | A1 * | 5/2012 | Mehring et al. | 123/41.08 |

(Continued)

FOREIGN PATENT DOCUMENTS

WO WO 03/025382 A1 3/2003

OTHER PUBLICATIONS

U.S. Patent Application of Matthew G. Holl entitled "Fuel Heating System for a Multi-Engine Machine" filed on Dec. 15, 2011, U.S. Appl. No. 13/326,758, 19 pages.

*Primary Examiner* — Jason C Smith
(74) *Attorney, Agent, or Firm* — Finnegan, Henderson, Farabow, Garrett & Dunner LLP

(57) ABSTRACT

An engine warming system for a machine is disclosed. The engine warming system may have a first engine and a second engine each connected to a dedicated first heat exchanger and a second heat exchanger, respectively. The engine warming system may also have a common heat exchanger connected to both the first and second engines to transfer heat between coolant flows from the first and second engines. Further, the engine warming system may have a first pump and a second pump driven by the first engine and second engine, respectively, to circulate coolant from the first and second engines through the common heat exchanger. The engine warming system may also have at least one coolant pump driven by power generated by at least one of the first and second engines, to circulate coolant from a non-operational one of the first and second engines through the common heat exchanger.

20 Claims, 3 Drawing Sheets

(56) References Cited

U.S. PATENT DOCUMENTS

2012/0272857 A1* 11/2012 Graab et al. ..... 105/26.05
2013/0152818 A1* 6/2013 Holl ..... 105/62.1
2013/0152819 A1* 6/2013 Kral ..... 105/62.2

* cited by examiner

ENGINE WARMING SYSTEM FOR A MULTI-ENGINE MACHINE

TECHNICAL FIELD

The present disclosure relates generally to an engine warming system and, more particularly, to an engine warming system for a machine powered by more than one engine.

BACKGROUND

Line-haul locomotives traditionally employed a single high-power internal combustion engine for driving the locomotive and supplying auxiliary demands. The duty cycle for these locomotives, however, required the engine to idle for long periods of time or the locomotive to maintain low train speeds. To improve fuel efficiency, reduce emissions, and prevent excessive wear and tear of a single large engine, many locomotive manufacturers now employ more than one engine to power a locomotive.

A modern multi-engine locomotive typically has two diesel engines, including a larger primary engine and a smaller auxiliary engine. Either one or both engines generate power to propel the locomotive. For example, at low throttle settings, only the smaller engine operates to provide power while the larger engine is turned off. At intermediate throttle settings, only the larger engine operates to provide power while the smaller engine is turned off. And at the highest throttle setting, both engines operate to provide power to the locomotive.

Multi-engine line-haul locomotives operate in a variety of environments, including in cold weather with ambient temperatures dipping below the freezing point of water. In such conditions, the engine coolant, typically water or a water-glycol mixture, may freeze causing damage to the engine block or to other engine components. Moreover, a cold engine may be unable to generate sufficient power because of inefficient fuel combustion at low temperatures.

One attempt to address the problems described above is disclosed in U.S. Pat. No. 6,636,798 of Biess et al. that issued on Oct. 21, 2003 ("the '798 patent"). In particular, the '798 patent discloses an auxiliary power unit made up of a secondary small engine for warming a non-operational primary engine. According to the method disclosed in the '798 patent, coolant from both the secondary engine and the primary engine is circulated through a heat exchanger in which coolant from the secondary engine transfers heat to coolant from the non-operational primary engine. In addition, the '798 patent discloses that electrical heaters are used to augment heating of the primary engine coolant by the heat exchanger.

Although the '798 patent discloses a system and a method of warming a primary engine using heated coolant from a smaller secondary engine, the method disclosed in the '798 patent requires additional electrical heaters to adequately heat the primary engine. These additional heaters not only make the system of the '798 patent more expensive, but also add complexity. Moreover, the '798 patent does not disclose any method of keeping the secondary engine warm in cold weather conditions after it has been turned off. Thus, when both the primary and the secondary engines of the '798 patent are non-operational, there may be a delay in starting of the primary engine because of the time initially required to heat and start the secondary engine and the time subsequently required by the secondary engine to heat the primary engine.

The engine warming system of the present disclosure solves one or more of the problems set forth above and/or other problems in the art.

SUMMARY

In one aspect, the present disclosure is directed to an engine warming system for a machine. The engine warming system may include a first engine fluidly connected to a dedicated first heat exchanger configured to control a temperature of coolant from the first engine and a second engine fluidly connected to a dedicated second heat exchanger configured to control a temperature of coolant from the second engine. The engine warming system may also include a common heat exchanger fluidly connected to the first engine and to the second engine and configured to transfer heat between coolant from the first engine and coolant from the second engine. Further, the engine warming system may include a first pump driven by the first engine to circulate coolant from the first engine through the first heat exchanger and the common heat exchanger and a second pump driven by the second engine to circulate coolant from the second engine through the second heat exchanger and the common heat exchanger. In addition, the engine warming system may include at least one coolant pump driven by power generated by at least one of the first and second engines, the at least one coolant pump configured to circulate coolant from a non-operational one of the first and second engines through the common heat exchanger.

In another aspect, the present disclosure is directed to a method of warming an engine. The method may include circulating coolant from a first engine through a first heat exchanger and circulating coolant from a second engine through a second heat exchanger. The method may further include selectively directing a coolant flow from the first engine and from the second engine through a common heat exchanger such that coolant from the first engine is used to heat coolant from the second engine. In addition, the method may include selectively directing a coolant flow from the first engine and from the second engine through the common heat exchanger such that coolant from the second engine is used to heat coolant from the first engine.

DETAILED DESCRIPTION

Figure 1:
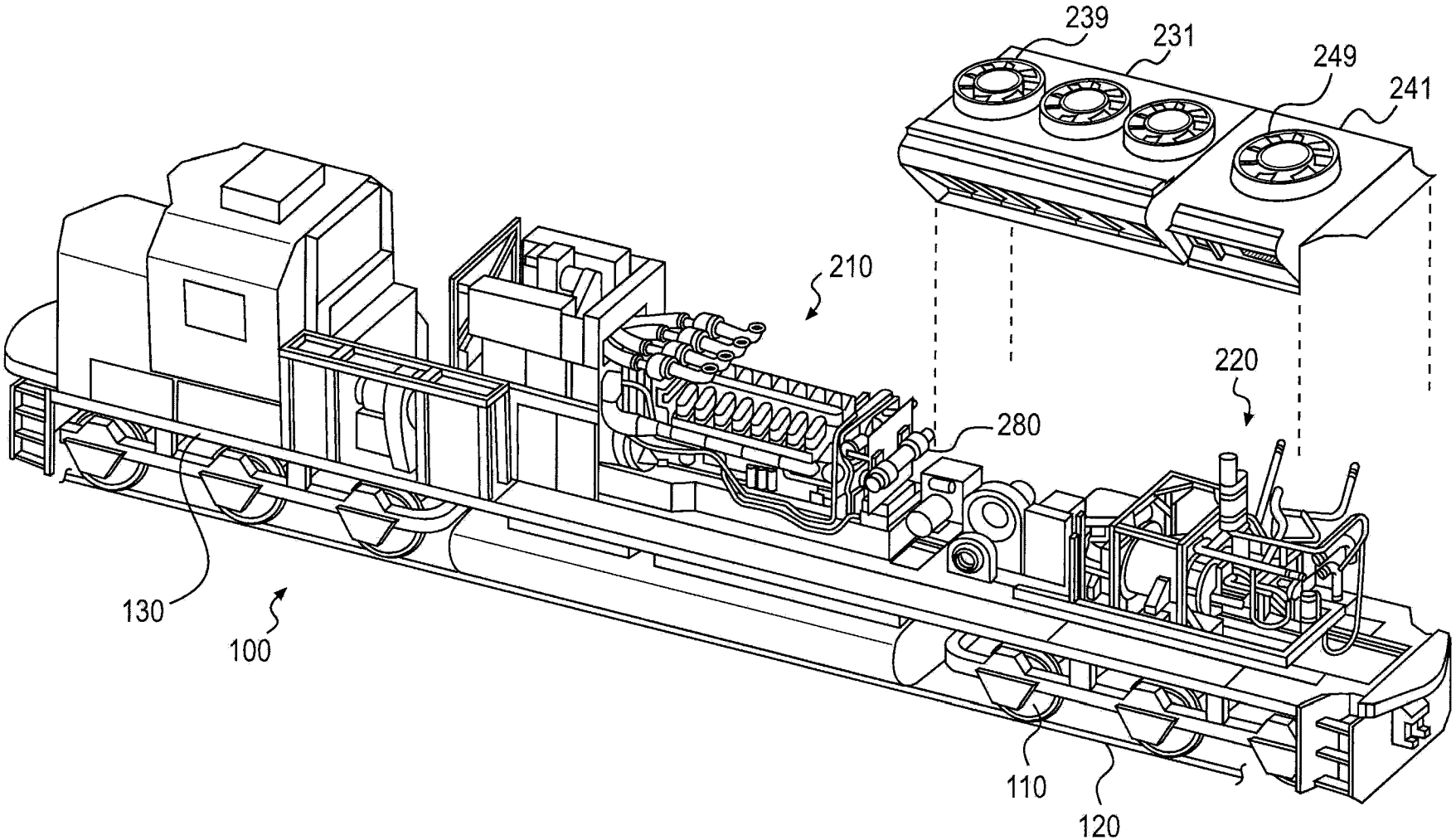
FIG. 1 is a pictorial illustration of an exemplary disclosed machine.

FIG. 1 illustrates an exemplary embodiment of a machine 100. Machine 100 may be a mobile machine that performs some type of operation associated with an industry such as the railroad industry or another industry known in the art. For example, machine 100 may be a locomotive designed to pull rolling stock. Machine 100 may have a plurality of wheels 110 configured to engage a track 120, a base platform 130 supported by wheels 110, and first and second engines 210 and 220 mounted to base platform 130 and configured to drive wheels 110. Any number of additional engines may be included within machine 100 and operated to produce power that may be transferred to one or more traction motors (not shown) used to drive wheels 110. In the exemplary embodiment shown in FIG. 1, first engine 210 and second engine 220 may be lengthwise aligned on base platform 130 along a travel direction of machine 100. One skilled in the art will recognize that first engine 210 and second engine 220 may be arranged in tandem, transversally, or in any other orientation on base platform 130.

In one embodiment of machine 100, first engine 210 may generate more power than second engine 220. Second engine 220 may be used to provide power to machine 100 at low throttle settings, for example, when machine 100 is pulling a relatively smaller load or when machine 100 is idling. In this situation, first engine 210 may be turned off. At intermediate throttle settings, only first engine 210 may operate to provide a higher level of power to machine 100, while second engine 220 may be turned off. In contrast, at the highest throttle setting, both first and second engines 210 and 220 may operate together to provide a highest level of power to machine 100.

First engine 210 may be any type of engine such as, for example, a diesel engine, a gasoline engine, or a gaseous fuel-powered engine. First engine 210 may include an engine block that at least partially defines a plurality of cylinders (not shown). The plurality of cylinders in first engine 210 may be disposed in an "in-line" configuration, a "V" configuration, or in any other suitable configuration. Similarly, second engine 220 may also be any type of engine such as, for example, a diesel engine, a gasoline engine, or a gaseous fuel-powered engine. Like first engine 210, second engine 220 may also include an engine block that at least partially defines a plurality of cylinders (not shown). The plurality of cylinders in second engine 220 may be disposed in an "in-line" configuration, a "V" configuration, or in any other suitable configuration.

First and second engines 210 and 220 may each be connected to a dedicated heat exchanger. For example, first engine 210 may be fluidly connected to a first heat exchanger 231. One or more cooling fans 239 may blow air across first heat exchanger 231 to chill coolant from first engine 210 to a desired temperature. Second engine 220 may similarly be connected to a second heat exchanger 241. One or more cooling fans 249 may blow air across second heat exchanger 241 to chill coolant from second engine 220 to a desired temperature.

Figure 2:
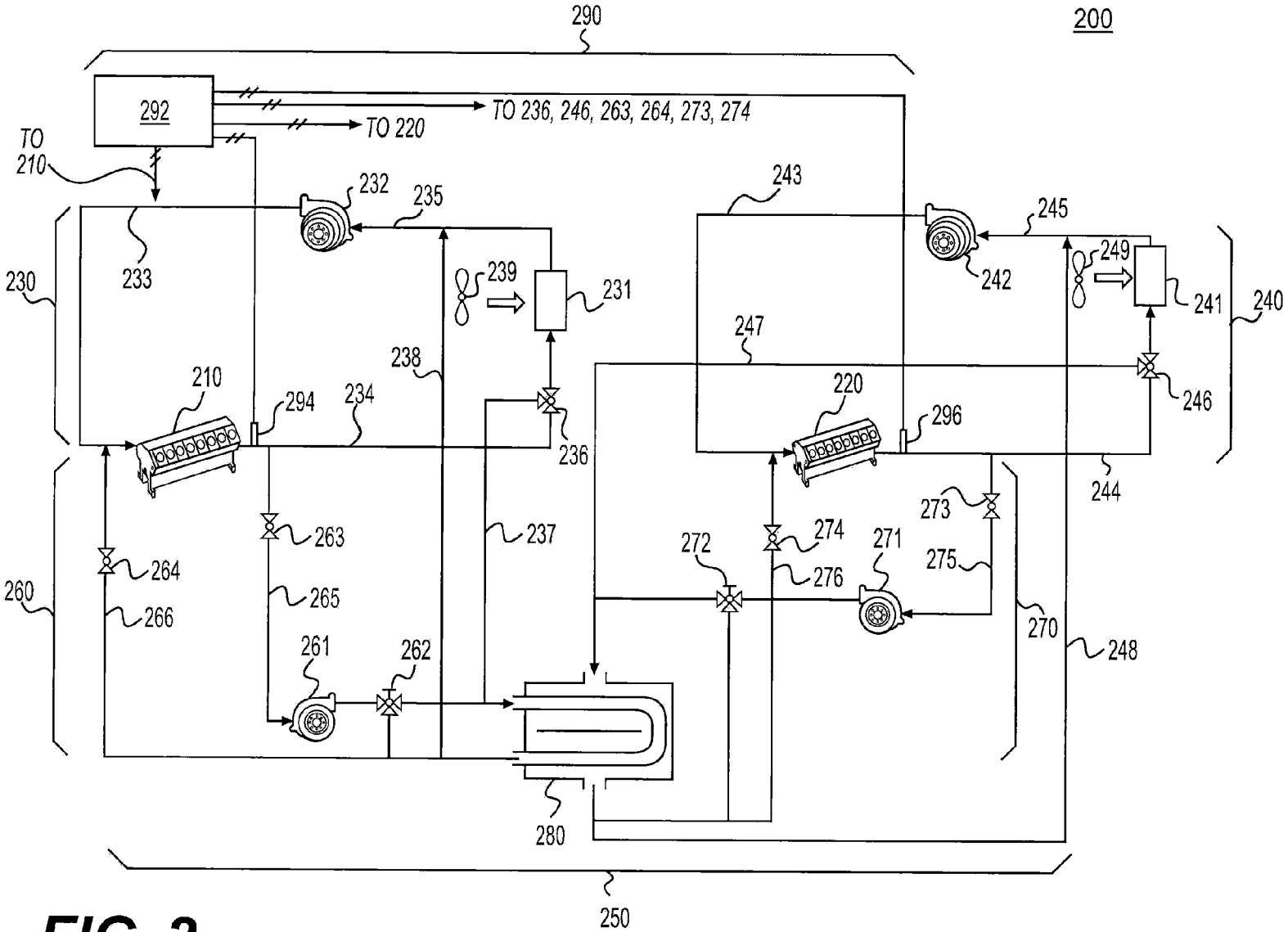
FIG. 2 is a schematic of an exemplary disclosed engine warming system that may be used in conjunction with the machine of FIG. 1.

FIG. 2 illustrates a schematic diagram of an engine warming system 200 that may be used in conjunction with machine 100 shown in FIG. 1. Engine warming system 200 may include components that cooperate to keep at least one of first and second engines 210 and 220 always warmed and ready for startup when necessary. Specifically, engine warming system 200 may include, among other things, a first circuit 230, a second circuit 240, and a heating arrangement 250. First circuit 230 may be associated with first engine 210. Second circuit 240 may be associated with second engine 220. Heating arrangement 250 may be associated with both first and second engines 210 and 220.

First circuit 230 may include components that cooperate to control a temperature of first engine 210. Specifically first circuit 230 may include first heat exchanger 231 and a pump 232 fluidly connected between first engine 210 and first heat exchanger 231. Coolant such as water, glycol, a water/glycol mixture, a blended air mixture, or any other heat transferring fluid may be pressurized by pump 232 and directed through a passageway 233 to first engine 210 to transfer heat therewith. After exiting first engine 210, the coolant may be directed through a passageway 234 to first heat exchanger 231 to again transfer heat therewith, and then be drawn through a passageway 235 back to pump 232. First circuit 230 may also include a control valve 236 for directing some or all of the coolant from passageway 234 to a common heat exchanger 280 through a passageway 237. After exiting common heat exchanger 280, coolant may be directed to return through a passageway 238 to passageway 235.

Second circuit 240 may include components that cooperate to control a temperature of second engine 220. Specifically second circuit 240 may include second heat exchanger 241 and a pump 242 fluidly connected between second engine 220 and second heat exchanger 241. Coolant such as water, glycol, a water/glycol mixture, a blended air mixture, or any other heat transferring fluid may be pressurized by pump 242 and directed through a passageway 243 to second engine 220 to transfer heat therewith. After exiting second engine 220, the coolant may be directed through a passageway 244 to second heat exchanger 241 to again transfer heat therewith, and then be drawn through a passageway 245 back to pump 242. Second circuit 240 may also include a control valve 246 for directing some or all of the coolant from passageway 244 to common heat exchanger 280 through a passageway 247. After exiting common heat exchanger 280, coolant may be directed to return through a passageway 248 to passageway 245.

First and second heat exchangers 231 and 241 may each embody the main radiators (i.e., high temperature radiators) of first and second engines 210 and 220, respectively, and be situated to dissipate heat from the coolant after it passes through first and second engines 210 and 220. As the main radiators of first and second engines 210 and 220, first and second heat exchangers 231 and 241 may be air-to-liquid type of heat exchangers. That is, a flow of air may be directed by cooling fans 239 and 249 through channels of each of first and second heat exchangers 231 and 241 such that heat from the coolant in adjacent channels is transferred to the air. In this manner, the coolant passing through first and second engines 210 and 220 may be cooled to a desired operating temperature of first and second engines 210 and 220 by first and second heat exchangers 231 and 241, respectively.

Cooling fans 239 and 249 may be associated with heat exchangers 231 and 241, respectively, to generate the flows of cooling air described above. In particular, cooling fans 239 and 249 may each include an input device (not shown) such as a belt driven pulley, a hydraulically driven motor, or an electrically powered motor that is mounted to or otherwise associated with first or second engines 210 and 220, and fan blades (not shown) fixedly or adjustably connected to the input device. Cooling fans 239 and 249 may be electrically, hydraulically, and/or mechanically powered by first and second engines 210 and 220 to cause the input devices to rotate and the connected fan blades to blow or draw air across heat exchangers 231 and 241, respectively. It is contemplated that cooling fans 239 and 249 may additionally blow or draw air across first and second engines 210 and 220, respectively, for external cooling thereof, if desired. Any number of cooling fans 239 and 249 may be used in engine warming system 200.

Pumps 232 and 242 may be engine-driven to generate the flows of coolant from an operational one of first and second engines 210 and 220, respectively. In particular, each of pumps 232 and 242 may include an impeller or other pumping mechanism (not shown) disposed within a volute housing having an inlet and an outlet. As coolant enters the volute housing, blades of the impeller may be rotated by operation of first or second engines 210 or 220 to push against the coolant, thereby pressurizing the coolant. It is contemplated that pumps 232 and 242 may alternatively embody piston type pumps, if desired, and may have a variable or constant displacement. One skilled in the art will recognize that any number of pumps 232 and 242 may be used to generate the flows of coolant in first and second circuits 230 and 240.

Control valve 236 may be a proportional type valve having a valve element movable to regulate a flow of coolant through passageway 234. The valve element in control valve 236 may be solenoid-operable to move between a flow-passing position and a flow-blocking position. In the flow-passing position, control valve 236 may permit substantially all of the fluid to flow through passageway 234 to first heat exchanger 231. In an intermediate position in between the flow-passing position and flow-blocking position, control valve 236 may permit some of the fluid to flow to first heat exchanger 231 while diverting a portion of the fluid to flow through passageway 237 to common heat exchanger 280. And in the flow-blocking position, control valve 236 may completely block fluid from flowing to first heat exchanger 231 by diverting substantially all the fluid to flow through passageway 237 to common heat exchanger 280. Control valve 246 may control the flow of fluid through passageways 244 and 247 to second heat exchanger 241 and common heat exchanger 280, respectively, in a similar manner.

Common heat exchanger 280 may be a liquid-to-liquid type heat exchanger. For example, common heat exchanger 280 may embody a flat-plate heat exchanger or a shell-and-tube heat exchanger. As a first flow of fluid passes through common heat exchanger 280, it may conduct heat through internal walls of common heat exchanger 280 to a second flow of fluid also passing through common heat exchanger 280. It is contemplated that the first and second flows of fluid in common heat exchanger 280 may be parallel flows, opposite flows, or cross flows, as desired. Although only one common heat exchanger 280 is shown in FIG. 2, one skilled in the art would recognize that more than one common heat exchanger 280 may be included in machine 100.

In one exemplary embodiment, the first and second flows of fluid passing through common heat exchanger 280 may consist of coolant flows from first and second engines 210 and 220. For example, when first engine 210 is operational and second engine 220 is non-operational, relatively warmer coolant from first engine 210 and relatively cooler coolant from second engine 220 may simultaneously flow through different channels in common heat exchanger 280. In this manner, the cooler coolant may be heated in common heat exchanger 280 to a desired temperature using the warmer coolant.

Heating arrangement 250 may include components that cooperate to allow coolant from one of first and second engines 210 and 220 to be heated using coolant from the other of first and second engines 210 and 220. Specifically, heating arrangement 250 may include common heat exchanger 280, a third circuit 260 associated with first engine 210, and a fourth circuit 270 associated with second engine 220.

Third circuit 260 may include components that cooperate to circulate coolant from first engine 210 through common heat exchanger 280. Specifically third circuit 260 may include a coolant pump 261, a thermostatic valve 262, and control valves 263 and 264. Coolant pump 261 may be configured to draw coolant from a water jacket (not shown) of first engine 210 through a passageway 265, pressurize the coolant, and pass the pressurized coolant through thermostatic valve 262 to common heat exchanger 280. After exiting common heat exchanger 280, the coolant may be directed through a passageway 266 and control valve 264 back to the water jacket of first engine 210. Valves 262, 263, and 264 may control the flows of coolant through third circuit 260.

Fourth circuit 270 may similarly include components that cooperate to circulate coolant from second engine 220 through common heat exchanger 280. Specifically fourth circuit 270 may include a coolant pump 271, a thermostatic valve 272, and control valves 273 and 274. Coolant pump 271 may be configured to draw coolant from a water jacket (not shown) of second engine 220 through a passageway 275, pressurize the coolant, and pass the pressurized coolant through thermostatic valve 272 to common heat exchanger 280. After exiting common heat exchanger 280, the coolant may be directed through a passageway 276 and control valve 274 back to the water jacket of second engine 220. Valves 272, 273, and 274 may control the flows of coolant through fourth circuit 270.

Coolant pumps 261 and 271 may be driven by electrical motors (not shown) or powered by batteries (not shown) in machine 100. The batteries used for powering coolant pumps 261 and 271 may be charged using power generated by either or both of first and second engines 210 and 220. Each of coolant pumps 261 and 271 may include an impeller or other pumping mechanism (not shown) disposed within a volute housing having an inlet and an outlet. As coolant enters the volute housing, blades of the impeller may be rotated by operation of electric motors (not shown) to push against the coolant, thereby pressurizing the coolant. It is contemplated that pumps 261 and 271 may alternatively embody piston type pumps, if desired, and may have a variable or constant displacement. Although only one of each of coolant pumps 261 and 271 is shown in FIG. 2, one skilled in the art would recognize that any number of electrically powered coolant pumps 261 and 271 may be included in engine warming system 200.

Thermostatic valves 262 and 272 may control the flow rate of coolant through common heat exchanger 280 to thereby regulate an amount of heat transferred between flows of coolant passing through common heat exchanger 280. For example, when a coolant temperature of first engine 210 is below a low threshold temperature, thermostatic valve 262 may open and direct a greater amount of coolant from first engine 210 to flow through common heat exchanger 280. Further, thermostatic valve 262 may close and reduce the flow of coolant from first engine 210 through common heat exchanger 280 when the temperature of coolant in first engine 210 exceeds a high threshold temperature by diverting the coolant flow from coolant pump 261 to passageway 266. When the temperature of coolant in first engine 210 lies between the low threshold temperature and the high threshold temperature, thermostatic valve 262 may open partially to allow some amount of coolant from first engine 210 to flow through common heat exchanger 280. In one exemplary embodiment, the low temperature threshold may be about 0° C. and the high temperature threshold may be about 80° C. Thermostatic valve 272 may control the flow rate of coolant from second engine 220 flowing through common heat exchanger 280 in a similar manner.

Control valve 263 may be a two position or proportional type valve having a valve element movable to regulate a flow of coolant through passageway 265. The valve element in control valve 263 may be solenoid-operable to move between a flow-passing position and a flow-blocking position. In the flow-passing position, control valve 263 may permit fluid to flow through passageway 265 substantially unrestricted by control valve 263. In contrast, in the flow-blocking position, control valve 263 may completely block fluid from flowing through passageway 265. Control valves 264, 273, and 274 may have structures similar to those of control valve 263. And, like control valve 263, control valves 264, 273, and 274 may also either permit or block flows of coolant through passageways 266, 275, and 276, respectively.

An engine start arrangement 290 may be used for starting a non-operational engine (e.g. first engine 210 or second engine 220) when a temperature of coolant in the non-operational engine falls below the low threshold temperature. Engine start arrangement 290 may include, among other things, a controller 292 to initiate startup of first and second engines 210 and 220 in response to signals from one or more sensors 294 and 296 that monitor the temperatures of coolant in first and second engines 210 and 220, respectively.

Controller 292 may embody a single or multiple microprocessors, digital signal processors (DSPs), etc. that include means for controlling an operation of first and second engines 210 and 220. Numerous commercially available microprocessors can be configured to perform the functions of controller 292. It should be appreciated that controller 292 could readily embody a microprocessor separate from that controlling other machine-related functions, or that controller 292 could be integral with a machine microprocessor and be capable of controlling numerous machine functions and modes of operation. If separate from the general machine microprocessor, controller 292 may communicate with the general machine microprocessor via datalinks or other methods. Various other known circuits may be associated with controller 292, including power supply circuitry, signal-conditioning circuitry, actuator driver circuitry (i.e., circuitry powering solenoids, motors, or piezo actuators), and communication circuitry.

Controller 292 may also be configured to regulate operation of control valves 236 and 246. For example, controller 292 may cause control valves 236 and 246 to direct some or all coolant to first and second heat exchangers 231 and 241 or to common heat exchanger 280 based on the signals received from sensors 294 and 296. In addition, controller 292 may also be configured to regulate operation of control valves 263, 264, 273, and 274. For example, controller 292 may cause control valves 263, 264, 273, and 274 to open or close based on the signals received from sensors 294 and 296. Further, controller 292 may be configured to regulate the operation of coolant pumps 261 and 271. For example, controller 292 may cause coolant pump 261 to start and circulate coolant from first engine 210 through common heat exchanger 280. Similarly, controller 292 may cause coolant pump 271 to start and circulate coolant from second engine 220 through common heat exchanger 280.

Figure 3:
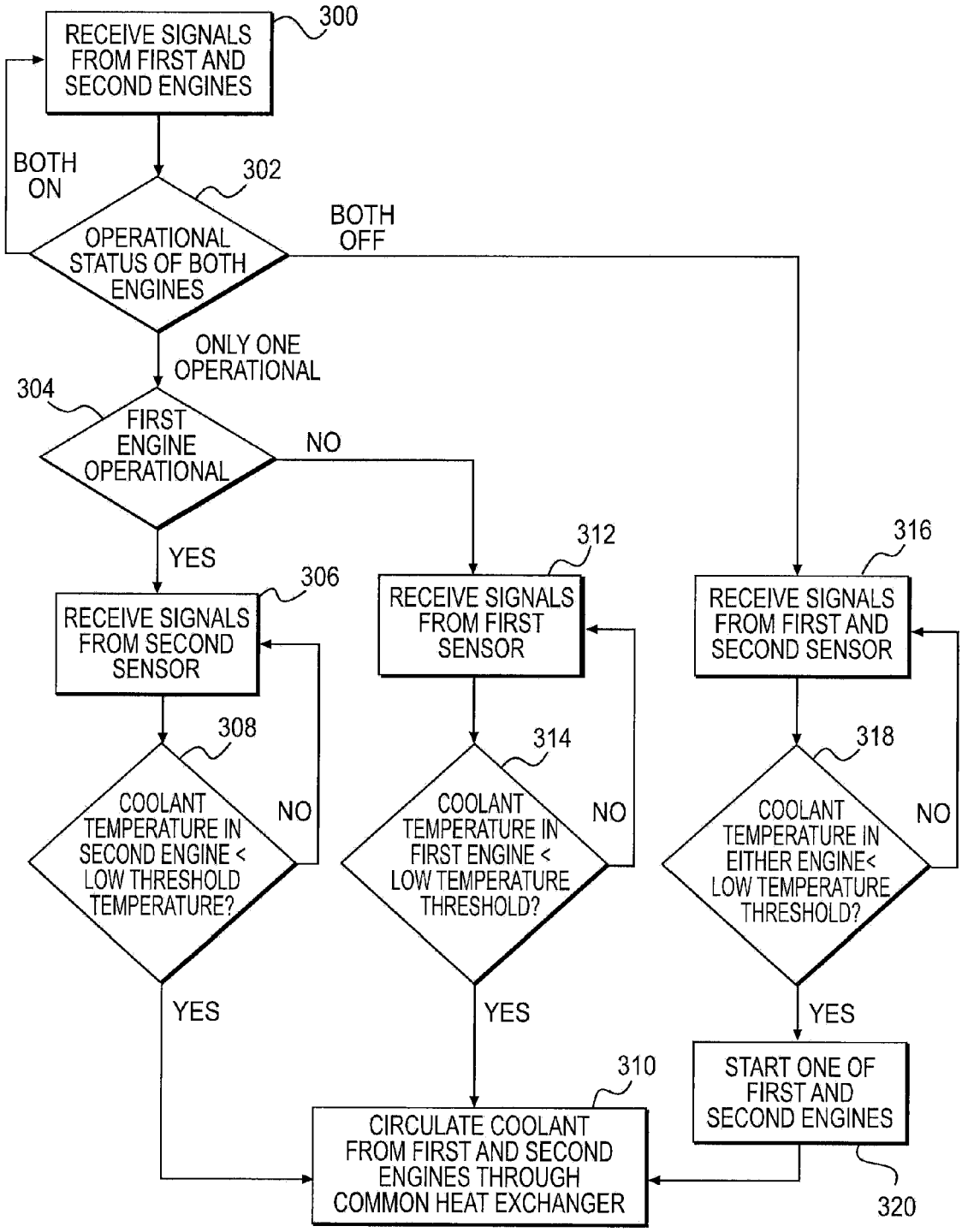
FIG. 3 is a flow chart illustrating an exemplary disclosed method performed by the engine warming system of FIG. 2.

FIG. 3 illustrates an exemplary operation performed by controller 292 during engine warming operations. FIG. 3 will be discussed in more detail in the following section to further illustrate the disclosed concepts.

INDUSTRIAL APPLICABILITY

The disclosed engine warming system may be used in any machine or power system application where it is beneficial to keep multiple engines warm and ready for immediate startup. The disclosed engine warming system may find particular applicability with mobile machines such as locomotives that can be exposed to extreme environmental conditions, including below-freezing ambient temperatures. The disclosed engine warming system may provide an improved method for warming a non-operational engine by drawing coolant from the non-operational engine, heating it in a heat exchanger using coolant from an operational engine, and circulating the heated coolant back through the non-operational engine to warm the non-operational engine. In addition, the disclosed engine warming system may be capable of starting one or more of the non-operational engines when a temperature of coolant in the non-operational engine drops below a low temperature threshold. Operation of engine warming system 200 will now be described.

During operation of machine 100, one or more of first and second engines 210 and 220 may be operational depending on the power output required to propel machine 100 at a desired speed. Further, in certain situations, both engines 210 and 220 may be non-operational. In the disclosed embodiment, engine warming system 200 may be activated when either or both of first and second engines 210 and 220 are non-operational.

Controller 292 may continuously monitor the temperatures and operation of first and second engines 210 and 220 to determine whether there is a need to warm or start the engines. In particular, controller 292 may receive signals from first and second engines 210 and 220 indicating whether the first and second engines 210 and 220 are operational or non-operational (Step 300). Controller 292 may ascertain based on these signals whether either or both of first and second engines 210 and 220 are operational or non-operational (Step 302). When controller 292 determines that only one of first and second engines is operational (Step 302), controller 292 may further ascertain whether first engine 210 is operational (Step 304).

When controller 292 determines that first engine 210 is operational but second engine 220 is non-operational (Step 304: YES), controller 292 may receive signals from sensor 296 (Step 306) and ascertain whether a temperature of coolant in second engine 220 is below the low threshold temperature (Step 308). When controller 292 determines that the temperature of coolant in second engine 220 is not below the low threshold temperature (Step 308: NO), controller 292 may continue receiving signals from sensor 296 (Step 206). When, however, controller 292 determines that the temperature of coolant in second engine 220 is below the low threshold temperature (Step 308: YES), controller 292 may direct control valves 273 and 274 to open. Controller 292 may also direct coolant pump 271 to pressurize coolant from a water jacket of second engine 220 thereby permitting relatively colder coolant from non-operational second engine 220 to begin circulating through common heat exchanger 280 (Step 310). At the same time, controller 292 may direct control valve 236 to permit the flow of some or all of the relatively warmer coolant from operational first engine 210 through common heat exchanger 280 (Step 310). Warm coolant, driven by pump 232, from operational first engine 210 may transfer heat to cold coolant from non-operational second engine 220 in common heat exchanger 280. Further, coolant pump 271 may circulate the heated coolant through non-operational second engine 220 thereby warming it and maintaining it in a ready condition for startup. Thus, engine warming system 200 may warm a non-operational second engine 220 and maintain it in a ready condition for startup without the need for additional coolant heaters or power sources for such heaters.

As another example, controller 292 may determine that first engine 210 is non-operational but second engine 220 is operational (Step 304: NO). In this situation, controller 292 may receive signals from sensor 294 (Step 312) and ascertain whether the temperature of coolant in first engine 210 is below a lower threshold temperature (Step 314). When controller 292 determines that the temperature of coolant in first engine 210 is not below the low threshold temperature (Step 314: NO), controller 292 may continue receiving signals from sensor 294 (Step 312). When, however, controller 292 determines that the temperature of coolant in first engine 210 is below the low threshold temperature (Step 314: YES), controller 292 may direct valves 263 and 264 to open. Controller 292 may also direct coolant pump 261 to pressurize coolant from a water jacket of first engine 210 thereby permitting relatively colder coolant from non-operational first engine 210 to begin circulating through common heat exchanger 280 (Step 310). At the same time, controller 292 may direct control valve 246 to permit the flow of some or all of the relatively warmer coolant from operational second engine 220 through common heat exchanger 280 (Step 310). Warm coolant, driven by pump 242, from operational second engine 220 may transfer heat to cold coolant from non-operational first engine 210 in common heat exchanger 280. Coolant pump 261 may circulate the heated coolant through first engine 210 thereby warming it and maintaining it in a ready condition for startup. Thus, engine warming system 200 may warm first engine 210 using heated coolant from second engine 220 thereby maintaining non-operational first engine 210 in ready condition for startup from a previously non-operational condition.

As another example of the operation of engine warming system 200, when controller 292 determines that both first and second engines are non-operational (Step 302), controller 292 may receive signals from sensors 294 and 296 (Step 316) indicating temperatures of coolant in first and second engines 210 and 220, respectively. Further, controller 292 may ascertain whether a temperature of coolant in first and/or second engines 210 and 220 has dropped below the low threshold temperature (Step 318). When controller 292 determines that the temperature of coolant in first and/or second engines 210 and 220 is not below the low threshold temperature (Step 318: NO), controller 292 may continue receiving signals from sensors 294 and 296 (Step 316). When, however, controller 292 determines that the temperature of coolant in first and/or second engines 210 or 220 is below the low temperature threshold, controller 292 may cause engine warming system 200 to responsively start one of first and second engines 210 and 220 (Step 320). In one exemplary embodiment in which second engine 220 is smaller than first engine 210, controller 292 may responsively start the smaller second engine 220 to provide warm coolant for heating the larger first engine 210. Controller 292 may also direct one of coolant pumps 261 and 271 and one or more of control valves 263, 264, 273, and 274 to circulate coolant from a non-operational one of first and second engines 210 and 220 through common heat exchanger 280 (Step 310). In addition, controller 292 may control one of control valves 236 and 246 to direct coolant from an operational one of first and second engines 210 and 220 to flow through common heat exchanger 280 (Step 310). Thus, engine warming system 200 may keep a non-operational one of first and second engines 210 and 220 in a ready condition for startup without introducing any delay in startup of the non-operational engine.

It will be apparent to those skilled in the art that various modifications and variations can be made to the disclosed engine warming system without departing from the scope of the disclosure. Other embodiments of the engine warming system will be apparent to those skilled in the art from consideration of the specification and practice of the engine warming system disclosed herein. It is intended that the specification and examples be considered as exemplary only, with a true scope of the disclosure being indicated by the following claims and their equivalents.

What is claimed is:

1. An engine warming system comprising:

a first engine fluidly connected to a dedicated first heat exchanger configured to control a temperature of coolant from the first engine;

a second engine fluidly connected to a dedicated second heat exchanger configured to control a temperature of coolant from the second engine;

a common heat exchanger fluidly connected to the first engine and to the second engine and configured to transfer heat between coolant from the first engine and coolant from the second engine;

a first pump driven by the first engine to circulate coolant from the first engine through the first heat exchanger and the common heat exchanger;

a second pump driven by the second engine to circulate coolant from the second engine through the second heat exchanger and the common heat exchanger; and at least one coolant pump driven by power generated by at least one of the first and second engines, the at least one coolant pump configured to circulate coolant from a non-operational one of the first and second engines through the common heat exchanger.

2. The engine warming system of claim 1, further including:

a first control valve configured to direct coolant from the first engine to flow through the common heat exchanger; and a second control valve configured to direct coolant from the second engine to flow through the common heat exchanger.

3. The engine warming system of claim 2, further including:

a first thermostatic valve configured to control a flow rate of coolant from the first engine through the common heat exchanger; and a second thermostatic valve configured to control a flow rate of coolant from the second engine through the common heat exchanger.

4. The engine warming system of claim 3, wherein the first control valve is located between the first engine and the first heat exchanger on a first passageway fluidly connecting the first engine to the first heat exchanger;

the second control valve is located between the second engine and the second heat exchanger on a second passageway fluidly connecting the second engine to the second heat exchanger;

the first thermostatic valve is located between the first engine and the common heat exchanger on a third passageway fluidly connecting the first engine to the common heat exchanger; and the second thermostatic valve is located between the second engine and the common heat exchanger on a fourth passageway fluidly connecting the second engine to the common heat exchanger.

5. The engine warming system of claim 1, further including:

a controller in communication with the first and second control valves and the at least one coolant pump, the controller being configured to selectively direct coolant flows from the first and second engines through the common heat exchanger.

6. The engine warming system of claim 5, wherein the controller is configured to start at least one of the first and second engines when one of a temperature of coolant from the first engine or a temperature of coolant from the second engine is below a low threshold temperature.

7. The engine warming system of claim 6, further including:

a first sensor configured to monitor a temperature of coolant in the first engine; and a second sensor configured to monitor a temperature of coolant in the second engine, wherein the controller is configured to start the at least one of the first and second engines based on signals received from the first and second sensors.

8. The engine warming system of claim 7, wherein the controller is further configured to direct the at least one coolant pump to circulate coolant from the first engine through the common heat exchanger when a temperature of coolant from the first engine is below the low threshold temperature and to circulate coolant from the second engine through the common heat exchanger when a temperature of coolant from the second engine is below the low threshold temperature.

9. A method of warming an engine comprising:

circulating coolant from a first engine through a first heat exchanger;

circulating coolant from a second engine through a second heat exchanger;

selectively directing a coolant flow from the first engine and from the second engine through a common heat exchanger such that coolant from the first engine is used to heat coolant from the second engine; and selectively directing a coolant flow from the first engine and from the second engine through the common heat exchanger such that coolant from the second engine is used to heat coolant from the first engine.

10. The method of claim 9, wherein selectively directing a coolant flow from the first engine and from the second engine through the common heat exchanger includes:

controlling a first control valve to direct a flow of coolant from the first engine through the common heat exchanger to heat coolant from the second engine when the first engine is operational and the second engine is non-operational; and controlling a second control valve to direct a flow of coolant from the second engine through the common heat exchanger to heat coolant from the first engine when the second engine is operational and the first engine is non-operational.

11. The method of claim 10, further including:

controlling at least one coolant pump driven by power generated by at least one of the first and second engines for circulating coolant from a non-operational one of the first and second engines through the common heat exchanger.

12. The method of claim 10, further including:

controlling a rate of flow of coolant from the first engine through the common heat exchanger when the first engine is non-operational and the second engine is operational such that the coolant from the first engine is heated to a high threshold temperature; and controlling a rate of flow of coolant from the second engine through the common heat exchanger when the second engine is non-operational and the first engine is operational such that the coolant from the second engine is heated to a high threshold temperature.

13. The method of claim 9, further including starting at least one of the first and second engines when both the first and second engines are non-operational and one of a temperature of coolant from the first engine or a temperature of coolant from the second engine is below a low threshold temperature.

14. A locomotive comprising:

a platform;

a plurality of wheels configured to support the platform;

a first engine mounted on the platform;

a second engine mounted on the platform;

a first heat exchanger fluidly connected to the first engine and configured to cool the first engine;

a second heat exchanger fluidly connected to the second engine and configured to cool the second engine;

a common heat exchanger fluidly connected to the first engine and the second engine to transfer heat between coolant from the first engine and coolant from the second engine;

a first pump configured to circulate coolant from the first engine through the first heat exchanger;

a second pump configured to circulate coolant from the second engine through the second heat exchanger;

a third pump configured to circulate coolant from the first engine through the common heat exchanger;

a fourth pump configured to circulate coolant from the second engine through the common heat exchanger;

a first thermostatic valve configured to control a flow rate of coolant from the first engine through the common heat exchanger;

a second thermostatic valve configured to control a flow rate of coolant from the second engine through the common heat exchanger; and a controller configured to control the third and fourth pumps to selectively direct coolant flows from the first and second engines through the common heat exchanger such that cooler coolant from either of the first and second engines is heated by warmer coolant from the other of the first and second engines.

15. The locomotive of claim 14, wherein the first pump is driven by the first engine and the second pump is driven by the second engine.

16. The locomotive of claim 15 wherein the third and fourth pumps are driven by power generated by at least one of the first and second engines.

17. The locomotive of claim 14, wherein the first thermostatic valve is configured to control a flow rate of coolant from the first engine through the common heat exchanger, and the second thermostatic valve is configured to control a flow rate of coolant from the second engine through the common heat exchanger.

18. The locomotive of claim 14, wherein the controller is configured to start at least one of the first and second engines when both the first engine and the second engine are non-operational and at least one of a temperature of coolant from the first engine and a temperature of coolant from the second engine is below a low threshold temperature.

19. The locomotive of claim 18, further including:

a first sensor configured to monitor a temperature of coolant in the first engine; and a second sensor configured to monitor a temperature of coolant in the second engine, wherein the controller is configured to start at least one of the first and second engines based on signals received from the first and second sensors.

20. The locomotive of claim 19, wherein the controller is further configured to direct the third pump to circulate coolant from the first engine through the common heat exchanger when the temperature of coolant from the first engine is below the low threshold temperature, and direct the fourth pump to circulate coolant from the second engine through the common heat exchanger when the temperature of coolant from the second engine is below the low threshold temperature.

* * * * *